US005862865A

United States Patent [19]

Murray et al.

[11] Patent Number: 5,862,865

[45] Date of Patent: Jan. 26, 1999

[54] INSERT GAS LIFT SYSTEM

[75] Inventors: Donald Murray; Jonathan Price; Gary E. Cooper, all of Aberdeen, Scotland

[73] Assignee: Baker Hughes Incorporated

[21] Appl. No.: 967,991

[22] Filed: Nov. 12, 1997

Related U.S. Application Data

[63] Continuation of Ser. No. 634,484, Apr. 18, 1996, abandoned.

[51] Int. Cl.[6] ..... E21B 34/06

[52] U.S. Cl. ..... 166/373; 166/386

[58] Field of Search ..... 166/373, 374, 166/375, 377, 322, 323, 386

[56] References Cited

U.S. PATENT DOCUMENTS

| | | | |
|---|---|---|---|
| 3,799,258 | 3/1974 | Tausch | 166/72 |
| 4,071,088 | 1/1978 | Mott | 166/375 |
| 4,215,746 | 8/1980 | Hallden et al. | 166/53 |
| 4,460,046 | 7/1984 | Pringle | 166/317 |
| 4,478,288 | 10/1984 | Bowyer | 166/372 |
| 4,534,414 | 8/1985 | Pringle | 166/317 |
| 4,660,647 | 4/1987 | Richart | 166/386 |
| 4,729,433 | 3/1988 | Jacob . | |
| 4,771,633 | 9/1988 | Jacob . | |
| 4,776,399 | 10/1988 | Jacob . | |
| 5,526,883 | 6/1996 | Breaux | 166/373 |

*Primary Examiner*—Frank S. Tsay
*Attorney, Agent, or Firm*—Rosenblatt & Redano P.C.

[57] ABSTRACT

An insert tool for pre-existing casing is disclosed which allows the use of existing control line connections to facilitate independent operation of a pair of safety valves. The insert is particularly useful when a pre-existing well is converted to gas lift operation and requires the use of downhole valves, such as tubing safety valve in combination with an annular-type safety valve. The tool can be readily reconfigured if one of the control lines becomes obstructed so that continuing independent operation of the two valve components can continue. Normal and emergency release techniques are also included when it is time to retrieve the insert assembly.

21 Claims, 4 Drawing Sheets

INSERT GAS LIFT SYSTEM

This application is a continuation of application Ser. No. 08/634,484, filed on Apr. 18, 1996, now abandoned.

FIELD OF THE INVENTION

The field of this invention relates to casing tubing inserts to facilitate operation of wells by gas lift methods.

BACKGROUND OF THE INVENTION

During production, flow from a given formation eventually begins to taper off. Gas lift techniques have been used to obtain additional production when such situations occur. Wells are typically run with a tubing safety valve which can be actuated from the surface by control lines which extend down to a particular segment of the casing. In some designs, the tubing safety valve is actuable by a series of two control lines which run outside the casing and through the casing wall in a section in which the tubing safety valve is to be mounted. When converting a pre-existing well having two connections for a tubing safety valve to future operation by gas lift, a tubing safety valve is used in conjunction with an annular-type safety valve. Since the pre-existing section of the casing has only two connections at a fixed interval, an insert is required that will operate with the pre-existing connections in the locations already in the casing to allow the necessary operations of the tubing safety valve and the annular safety valve to facilitate the continuing operation by gas lift.

Accordingly, one of the objects of the present invention is to provide for an insert that can be located and secured in the proper position which allows for independent operation of the tubing safety valve and the annular safety valve. In addition, if one of the pre-existing control lines to the casing section becomes obstructed, the insert has as an objective features which will allow the continuing operation independently of the tubing safety valve from the annular safety valve with some minor modifications to the insert, itself. As another object, the insert has an emergency release provision which facilitates simple removal when the standard removal techniques do not result in a release. Another object of the insert tool of the present invention is to provide a fast and simple way to reconfigure the tool to allow independent operation of the tubing safety valve and the annular safety valve in the event one of the control lines becomes obstructed. These objects and how they are achieved can be better understood by a review of drawings and description of the preferred embodiment.

SUMMARY OF THE INVENTION

An insert tool for pre-existing casing is disclosed which allows the use of existing control line connections to facilitate independent operation of a pair of safety valves. The insert is particularly useful when a pre-existing well is converted to gas lift operation and requires the use of downhole valves, such as a tubing safety valve in combination with an annular-type safety valve. The tool can be readily reconfigured if one of the control lines becomes obstructed so that continuing independent operation of the two valve components can continue. Normal and emergency release techniques are also included when it is time to retrieve the insert assembly.

DETAILED DESCRIPTION OF THE PREFERRED EMBODIMENT

Figure 1A:
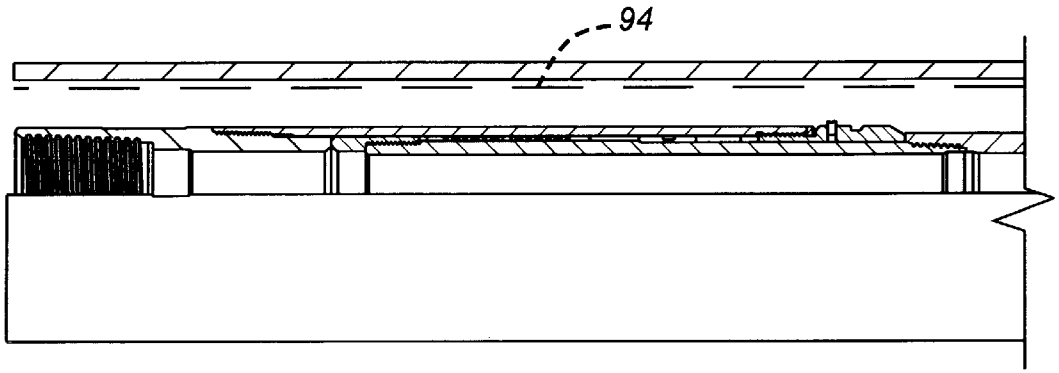
FIGS. 1*a*–1*e* illustrates the insert assembly in the set position.
Figure 1B:
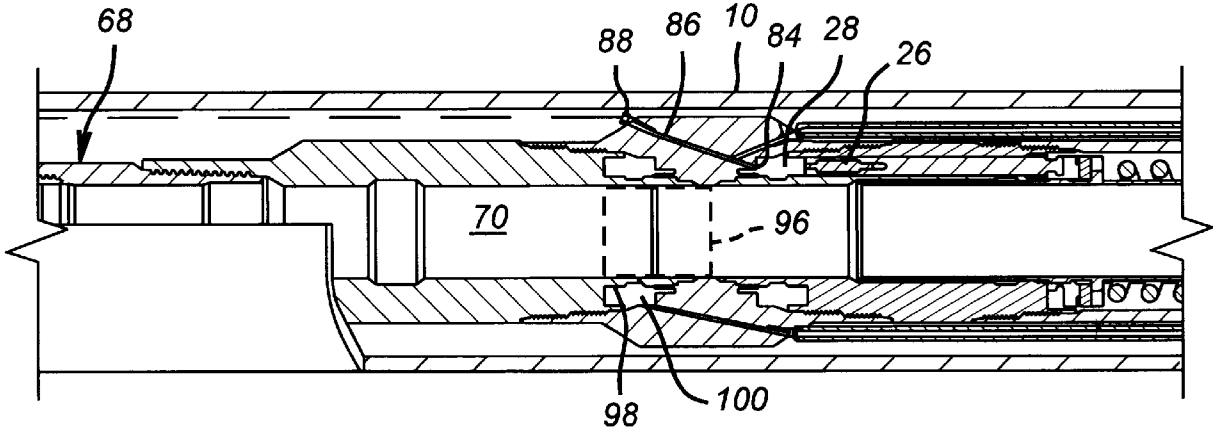
Figure 1C:
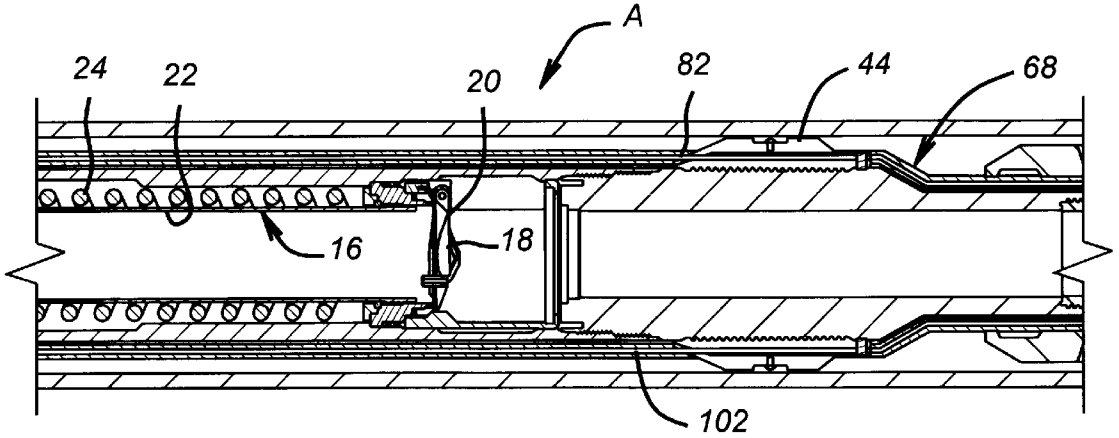
Figure 1D:
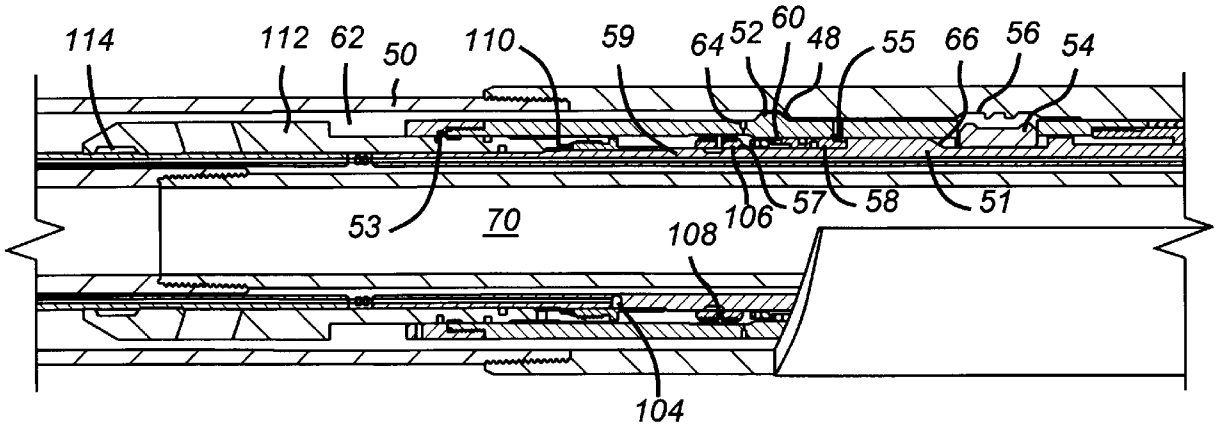

The various operations of the apparatus A of the present invention are depicted in FIGS. 1*a*–1*e* and 2. In FIG. 1, the pre-existing casing or tubing 10 is already in the wellbore. The casing 10 has connections 12 and 14. Connections 12 and 14 are affixed to tubing that runs outside of the casing 10 to the surface. Prior to the insertion of the apparatus A within the casing 10, the pre-existing well in this section of the casing 10 accommodated a tubing safety valve that had a pair of control lines connected to connections 12 and 14 for actuation thereof. The insert assembly of the apparatus A is illustrated in the entirety of FIG. 1. It features a spring loaded tubing safety valve, generally referred to as 16, which is of a type well known in the art. The tubing safety valve 16 has a flapper 18 which is biased by a spring 20. A tube 22 is biased by spring 24 so that when the tube 22 is in its up position, as shown in FIGS. 1*b* and 1*c*, the flapper 18 is in the closed position at the urging of spring 20. In order to hold the flapper 18 open, pressure is provided above piston 26. That pressure is applied to a chamber 28 above piston 26.

At the lower end of the apparatus A is an annular tubing safety valve 30. The tubing safety valve 30 is of a type well known in the art and generally has a sliding sleeve 32 which has a port 34. When port 34 is in alignment with passage 36, the valve is open. In the position shown in FIG. 1*e*, the valve is closed. The sliding sleeve 32 is biased by spring 38. Piston 40 displaces sleeve 32 when pressure is applied in conduit 42 which communicates with piston 40. When piston 40 moves, it displaces fluid against the sleeve 32 which ultimately compresses spring 38 bringing the port 34 into alignment with opening or passage 36.

The apparatus A has a plurality of centralizers 44 to properly locate it within the casing 10. The casing 10 has a no-go shoulder 48. The apparatus A has an outer sleeve 50 which has a tapered projection 52 to catch the no-go shoulder 48.

FIG. 1 shows the released position with locking dogs 54 retracted away from locking grooves 56. The run-in procedure requires landing projection 52 on sleeve 50 against no-go shoulder 48. Segment 112 then bears down on sleeve 51 breaking ring 53 and in turn causing tapered surface 66 to cam dogs 54 into grooves 56, while lock ring 106 held by shear pin 108 holds the locked piston. Piston 58 abuts sleeve 50 and has its initial position retained by shear pin 60. The annular space 62 located between the apparatus A and the casing 10 communicates through passage 64 to piston 58. Passage 64 is a vent that allows sleeve 51 to move down without becoming hydraulically locked.

Figure 1E:
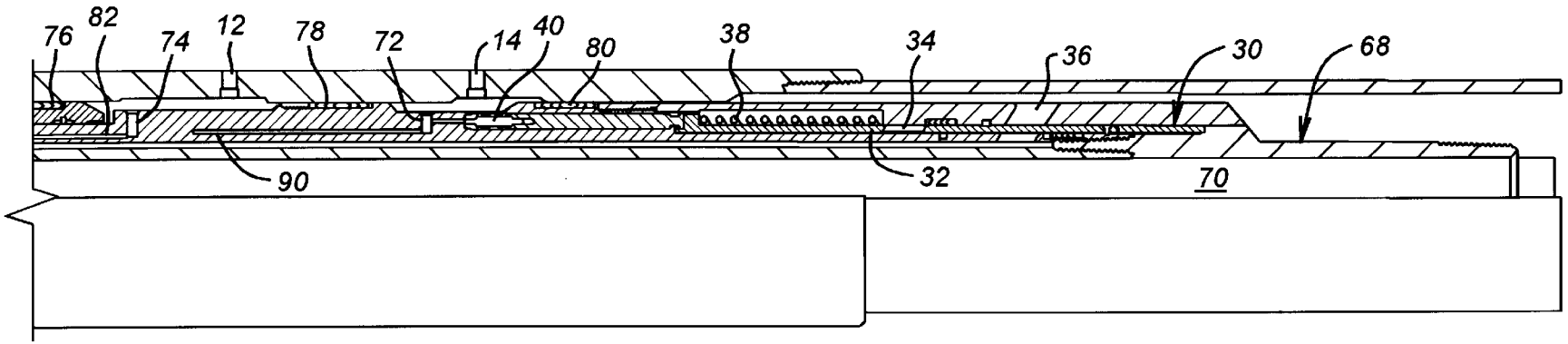
Figure 2:
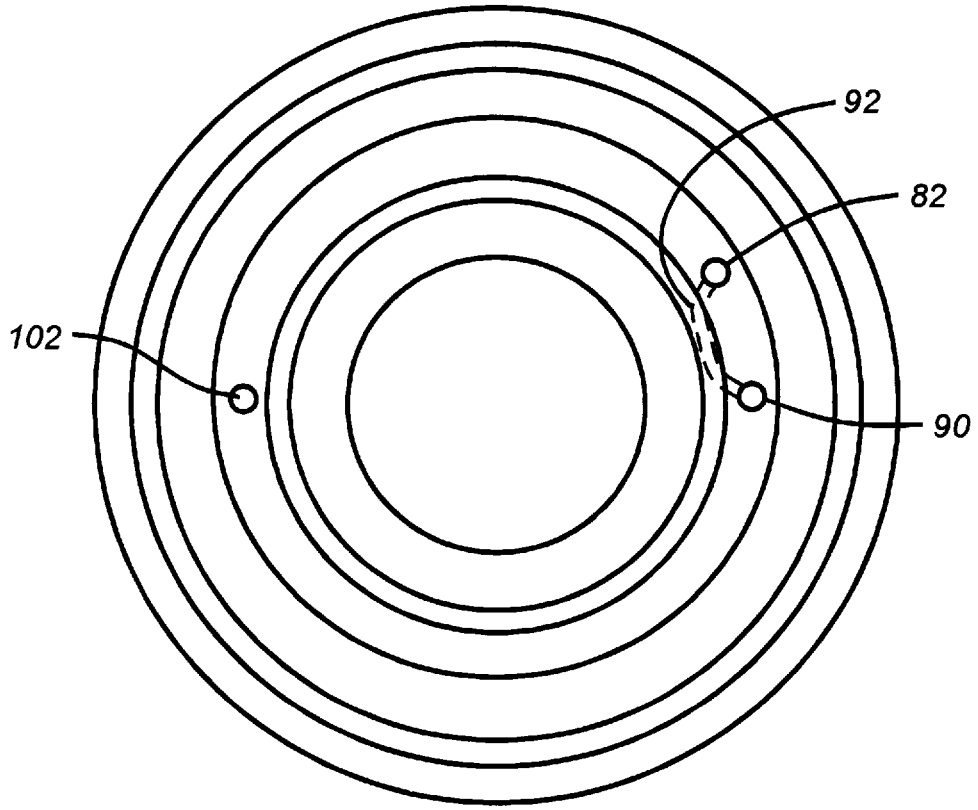
FIG. 2 is a section view along lines 2—2 of FIG. 1.

The apparatus A has a body 68 which has an internal passage 70. When secured in the manner previously described, the body 68 has openings 72 and 74. Opening 74 is sealed from the annulus 62 by seals 76 and 78. Opening 72 is sealed from annulus 62 by seals 78 and 80. Opening 74 communicates with tube 82. Tube 82 extends uphole past the centralizers 44 and ultimately to connection 84 which communicates with chamber 28, as shown in FIG. 1*b*. An auxiliary line 86 tees off tube 82 to a blanked-off connection 88. A second and parallel tube 90 runs along tube 82 and is better seen in the cross-section of FIG. 2. Parts of tube 90 are visible in FIG. 1*e* illustrating that it leads from opening 72 which is also in communication with the piston 40 for the annular safety valve 30.

The significant features of the apparatus A for run-in and setting and operation, but not for release, having been described, the different permutations of operation will now be explained in more detail. One of the advantages of the apparatus A of the present invention is that it allows for independent operation of the annular safety valve 30 and the tubing safety valve 16. This independent operation is accomplished by using the control lines connected to connections 12 and 14 for the discrete operations of the annular safety valve 30 and the tubing safety valve 16. Connection 14 during normal operation is in fluid communication with opening 72 and piston 40. Accordingly, pressure applied during normal operations to connection 14 from the surface of the wellbore will result in opening of the annular safety valve 30. Independently, pressure applied to connection 12 which communicates with opening 74 will transmit fluid pressure through tube 82 ultimately through connection 84 into chamber 28 to move piston 26. As a result, the tubing safety valve 16, through its sliding sleeve or tube 22, is operated independently of the annular safety valve 30. However, conditions could arise where one of the lines leading to connections 12 or 14 is obstructed or otherwise not serviceable to accomplish the movement of the particular element to which it is normally connected. The apparatus A of the present invention can cope with that situation. For example, if, for some reason, pressure cannot be applied to opening 72 through connection 14. When that occurs, tube 90 is pressed into service. A jumper line 92, shown in dashed lines in FIG. 2, can be placed on the body 68 across tubes 82 and 90. When placing the jumper 92 between tubes 82 and 90, tube 82, which is initiated at opening 74, runs directly back through tube 90 to piston 40. Thus, when connection 14 is obstructed, connection 12 can be used to operate the annular safety valve 30. By placing the jumper 92, tube 82 is disconnected from connection 84. In order to operate the tubing safety valve 16 during a condition when connection 14 is not serviceable, access to piston 26 is separately provided through connection 88. In order words, the apparatus A, upon realization that the connection 14 is not serviceable, is configured at the surface and run into position in the wellbore, as shown in FIG. 1, with an external tube shown in dashed lines 94 which extends from the surface to connection 88. Accordingly, independent operation of the tubing safety valve 16 and the annular safety valve 30 is retained despite the fact that connection 14 is no longer serviceable.

The opposite condition can occur where connection 12 becomes unserviceable. In that event, only connection 14 is serviceable and, therefore, provides access to opening 72 in the normal manner to operate the annular safety valve 30. Once again, the tube 94 is pressed into service from the surface and is connected to connection 88 for access to chamber 28 for actuation of piston 26 for operation ultimately of the tubing safety valve 16. Again, when connection 12 is no longer in service, independent operation of the annular safety valve 30 and the tubing safety valve 16 is still possible. It should be noted that in the event connection 14 is not serviceable, opening 72 is capped off to avoid pressurizing connection 14 by virtue of pressure in tube 90 with the jumper 92 applicable. Conversely, if connection 12 is not serviceable, opening 74 is plugged off to avoid pressurizing connection 12 from pressure applied through tube 94 which is pressed into service and connected to connection 88.

Another situation that could occur is that both connections 12 and 14 become unserviceable. If that occurs, independent operation of the tubing safety valve 16 and the annular safety valve 30 is no longer attained. However, tandem operation is possible. In the event of such an occurrence, both openings 74 and 72 are blanked off. Jumper 92 connects tube 82 to tube 90. Tube 94 is pressed into service and at the same time provides, through connection 88, direct fluid communication to chamber 28 and through jumper 92 fluid pressure to tube 90 to actuate the annular safety valve 30. What is different in this situation is that when the jumper 92 is placed in service between tubes 82 and 90, the upper portion of tube 82, which communicates with auxiliary line 86, is left in place so that connection 88 in effect feeds in tandem the chamber 28 for the tubing safety valve 16 and the piston 40 of the annular safety valve 30.

When it is time to release the apparatus A of the present invention, a communication tool 96 of a type known in the art is located as shown in FIG. 1*b*. The communication tool 96 is capable of laterally boring through the wall 98 and into chamber 100. Chamber 100 is connected to tube 102 which passes past the centralizers 44 into chamber 104.

As previously described, the setting of the tool involves the biasing outwardly of the dogs 54 by the tapered surface 66. The sleeve 51 after camming the dogs 54 outwardly into matching groove 56 has its position held by mating lock rings 106. Lock rings 106 have a shear pin 108 extending therethrough. After the communication tool 96 provides for access into chamber 98, the opening made by the tool 96 is isolated within the passage 70 to allow pressure buildup from the surface into chamber 98 and therefore through tube 102 and against a portion of the lock ring 106.

Piston 58, which moves after shear screws 55 are broken. A split load ring 57 then becomes unsupported which allows sleeve 51 to move with respect to sleeve 50 which on an upward force from the surface desupports dogs 54 to allow removal. An emergency release is provided in case the technique just described for release of the apparatus A from the casing 10 does not operate properly. The body 68 has a segment 112 which has a fishing neck 114. A cutting tool is inserted in passage 70 to below fishing neck 114. A pulling tool grabs neck 114 and pulls up segment 112 to shear ring 110. When ring 110 shears sleeve 59 can come up allowing lock ring 106 to collapse which in turn raises tapered surface 66 to release dogs 54.

Those skilled in the art will now appreciate that what has been disclosed is a retrofit application for an existing wellbore, which is to be converted to gas lift operation. With such a conversion, or for other reasons, it may be desirable to have independently operating tubing safety valves, such as the type illustrated as 16 and an annular subsurface valve 30. The apparatus of the present invention uses pre-existing connections in their predetermined position, i.e., connections 12 and 14 to accomplish the independent feature. Furthermore, even if one of the two connections is no longer serviceable, the apparatus gives the ability for independent operation from the surface through the use of the jumper line 92 using the techniques as described above. Even if both connections 12 and 14 become obstructed or not serviceable, tandem operation of the two elements 16 and 30 is still possible. The apparatus A is directly configured to be readily in the appropriate position upon the contact of the projection 52 with the no-go shoulder 48. Normal retrieval is accomplished with the use of a known penetration tool 96 to bore through the wall 98 into the chamber 100. Even an emergency release is provided. With the independent operation that is made available through the apparatus of the present invention, the tubing safety valve 16 can easily be tested by allowing formation pressure to enter below valve 16 when it is in the closed position so that leakage can be monitored. Alternatively, the performance of the annular safety valve 30 can be tested independently of the operation of the tubing safety valve 16 by reversing the valve position with valve 16 open and valve 30 in the closed position.

According, operators of existing wells, which now need to be converted to gas lift operation, for further economical exploitation of the minerals, have a simply designed tool which meats the contingencies that can be encountered downhole, yet provides the flexibility of the independent operation of two downhole final controlled elements, such as, for example, the tubing safety valve 16 and the annular safety valve 30.

The apparatus of the present invention has many good features and benefits. It can be retrofitted into any nipple profile. As long as the well has an existing safety valve landing nipple or a locked open, tubing-retrievable safety valve, the apparatus of the present invention can be retrofitted. The apparatus is installable in a single trip with the entire system, including the tubing and annular safety valves, installed together, simply on a coiled tubing string. There is no need for expansion devices, unlike two-trip systems.

The tubing safety valve which is employed is a performance-proven design, featuring metal-to-metal and nonelastomeric safety valves, with minimum numbers of moving parts to further enhance reliability and service life. Once the apparatus is locked in the nipple profile, release occurs by use of a punch-type communication tool, followed by application of tubing pressure which therefore precludes inadvertent release through straight tensile loads or well intervention work through the tubing. The tool provides an emergency release using standard through-tubing fishing tools and, therefore, no special tools are required to release the system should the primary release mechanism become inoperable. The tool has continuous throughbore with no internal sleeves, which minimizes the pressure drop through the tubing to maximize production. None of the features of the tool can be inadvertently actuated or activated through well intervention work.

The release mechanism is not in either flowpath; rather, it is contained within a clean, open environment. Again, this results in preventing inadvertent release through well intervention work. The release mechanism is also unaffected by scale or debris which could foul up the operation of the lock mechanism. The annular safety valve used in the apparatus uses sleeve-type mechanisms to minimize pressure drop, hence minimizing scale or debris deposits within the valve. This is because the float does not pass over the critical sealing components of the valve which occurs in puppet-type valves. The design of the annular safety valve used does not allow the sealing surfaces to become eroded because of flow.

The release system involving a one-trip wireline field communication tool takes away the need to have linear motion or internal sleeves, which in turn removes the chance of inadvertent actuation by wireline tools since the annular cavity 98 extends for 360°. The penetration tool 96 can be used more than once if it is unsuccessful for any reason. What results is a simpler design which is more reliable.

Once the apparatus is in place, the loads are taken by the locking dogs 54 rather than the no-go shoulder 48. This reduces the risk of sticking the apparatus in the nipple profile due to excessive loads on the no-go shoulder 48. The tubing safety valve assembly can be of a retrievable type which can help prolong well life and avoid costly workovers. Both the tubing safety valve and the annular safety valve have the capability of being pumped through from above, which means that kill operations can be performed should control line integrity be lost. The preferred embodiment employs metal-to-metal seals between the annulus and the tubing which are all static. By eliminating elastomers or dynamic metal-to-metal, a more reliable design results.

The foregoing disclosure and description of the invention are illustrative and explanatory thereof, and various changes in the size, shape and materials, as well as in the details of the illustrated construction, may be made without departing from the spirit of the invention.

We claim:

1. A method of converting an existing well having at least one control line running into a casing segment from operation with a single subsurface safety valve into a multivalve operation, comprising:

removing the existing subsurface safety valve;

inserting an apparatus which is supported in the casing segment and which further comprises a first and a second inlet;

positioning said apparatus so that said at least one control line is in fluid communication with at least one of said first and second inlets;

connecting said first inlet on the apparatus to at least a first safety valve and said second inlet on the apparatus to at least a second safety valve;

independently operating said safety valves using said at least one control line.

2. The method of claim 1, further comprising:

stacking said first and second safety valves in a stack on said apparatus with said first safety valve on top of said second safety valve.

3. The method of claim 2, further comprising:

connecting a first conduit from said first inlet to a first operator for said first safety valve;

orienting an auxiliary connection on said first conduit so that it is accessible from above said first safety valve.

4. The method of claim 3 further comprising:

connecting a second conduit from said second inlet to a second opera tor on said second safety valve;

running at least a portion of said second conduit adjacent said first conduit.

5. The method of claim 1, further comprising:

using a first and second control line, respectively connected to said first and second inlets;

selectively independently operating said safety valves if either of the control lines in the casing become unserviceable.

6. The method of claimed further comprising:

using a first and second control line, respectively connected to said first and second inlets;

independently operating said safety valves if said first control line becomes unserviceable by using said auxiliary connection to operate said first safety valve.

7. The method of claim 6, further comprising:

blocking said first inlet when operating said first safety valve using said auxiliary connection.

8. The method of claim 7, wherein:

connecting an auxiliary line to said auxiliary connection such that when said first inlet is blocked and said apparatus attains support in the casing segment, independent operation of said safety valves is possible.

9. The method of claim 4, further comprising:

using a first and second control line, respectively connected to said first and second inlets;

independently operating said safety valves if said second control line becomes unserviceable by using said auxiliary connection to operate said first safety valve;

re-running said first conduit into said second conduit instead of to said first operator.

10. The method of claim 9, further comprising:

blocking said second inlet when operating said second safety valve from said first inlet.

11. The method of claim 10, further composing:

connecting an auxiliary line to said auxiliary connection such that when said first inlet is blocked and said apparatus attains support in the casing segment, independent operation of said safety valves is possible.

12. The method of claim 1, further comprising:

securing said apparatus to said casing segment by set down weight.

13. The method of claim 12, further comprising:

locking said apparatus by set down weight and selectively hydraulically unlocking for release.

14. The method of claim 13, further comprising:

penetrating a wall of the apparatus to reach a chamber in said wall;

applying pressure through an opening made in the wall of the apparatus against a lock mechanism through said chamber;

hydraulically overcoming the lock mechanism for normal release.

15. The method of claim 12, further comprising:

camming at least one dog on the apparatus into a profile on the casing segment to secure said apparatus;

using a lock ring to hold said dog to said profile.

16. The method of claim 15, further comprising:

defeating said lock ring;

moving a cam on said apparatus to unsupport said dog for normal release.

17. The method of claim 16, further comprising:

cutting off a portion of said apparatus above a fishing neck to undermine said lock ring if normal release is not achieved;

exposing said fishing neck on the apparatus;

grabbing said fishing neck and creating relative movement in said apparatus to move said cam away from said dog.

18. The method of claim 1, further comprising:

using a projection on one part of said apparatus to engage a shoulder on one part of said casing segment for support;

aligning at least one dog on another part of the apparatus with a recess on another part of said casing segment when said projection engages said shoulder;

camming said dog into said recess;

locking said dog into said recess.

19. The method of claim 5, further comprising:

operating said first and second safety valves in tandem if both said first and second conduits become unserviceable.

20. The method of claim 4, further comprising:

connecting said second conduit to said first conduit;

connecting an auxiliary line to said auxiliary connection;

blocking said first and second inlets;

actuating said first and said second safety valves in tandem.

21. The method of claim 1, further comprising:

using a first and second control line respectively connected to said first and second inlets;

independently operating said safety valves using said first and second control lines.

* * * * *